United States Patent [19]

Fatton

[11] 4,188,779

[45] Feb. 19, 1980

[54] ELECTRONIC TIMEPIECE CAPABLE OF SIMULATING AND DISPLAYING A GAME OF CHANCE

[75] Inventor: Jean-Claude Fatton, Le Landeron, Switzerland

[73] Assignee: Ebauches Electroniques SA, Marin, Switzerland

[21] Appl. No.: 841,213

[22] Filed: Oct. 11, 1977

[30] Foreign Application Priority Data

Oct. 21, 1976 [CH] Switzerland ..... 13300/76

[51] Int. Cl.[2] ..... G04B 47/04

[52] U.S. Cl. ..... 58/153; 58/152 R; 58/50 R; 235/92 GA; 273/138 A

[58] Field of Search ..... 58/152 R, 153, 23 R, 58/57.5 OR; 235/92 GA; 273/138 A; 364/410, 411, 412

[56] References Cited

U.S. PATENT DOCUMENTS

| | | | |
|---|---|---|---|
| 3,357,703 | 12/1967 | Hurley | 58/152 R |
| 3,791,650 | 2/1974 | Dice | 273/138 A |
| 3,834,710 | 9/1974 | Sousan | 273/138 A |
| 4,034,988 | 7/1977 | Goldner | 273/138 A |

*Primary Examiner*—Gene Z. Rubinson
*Assistant Examiner*—William L. Feeney
*Attorney, Agent, or Firm*—Imirie & Smiley

[57] ABSTRACT

Electronic timepiece with a device for indicating the time, which is electronically controlled and is used to display elements which simulate a game of chance. Additional circuits are provided for the control of the display of the elements of the game and at least part of the circuits of the timepiece, normally intended for the measure of the time are used in order to perform the choice at random of the elements.

16 Claims, 5 Drawing Figures

ELECTRONIC TIMEPIECE CAPABLE OF SIMULATING AND DISPLAYING A GAME OF CHANCE

BACKGROUND OF THE INVENTION

The present invention relates to an electronic timepiece with a device for indicating the time, which is electronically controlled and is used to display elements which simulate a game of chance.

From U.S. Pat. No. 3,357,703, an apparatus comprising a clock with a game of dice is already known. The device, which is entirely of an electromechanical construction with relays and motors, comprises a clock as an accessory function. It is actuated by a piece of money, does occupy a limited space on the floor and is capable to be remote controlled by means of an emitter-receiver pair.

However such an apparatus could not be used in a watch because of its whole concept and of its electromechanical design.

SUMMARY OF THE INVENTION

It is therefore intended to provide an electronic timepiece with a game function performed by an additional electronic circuit which is integrated on the same substrate as that of the time measuring elements.

Preferably, one part of the display of the timepiece is capable to exhibit a simplified image of a dice or a roulette. The additional circuit is provided in order to display at random an image of a dice or a roulette and/or a number. It is thus possible to simulate the conditions of a game of chance where any influence on the result by the player is avoided.

The timepiece according to the presence invention comprises additional circuits for the control of the display of said elements and at least part of the circuits of the timepiece are used in order to perform the choice independent of said elements.

The present invention will be described further by way of example, with reference to the accompanying drawings.

DESCRIPTION OF THE PREFERRED EMBODIMENT

Figure 1:
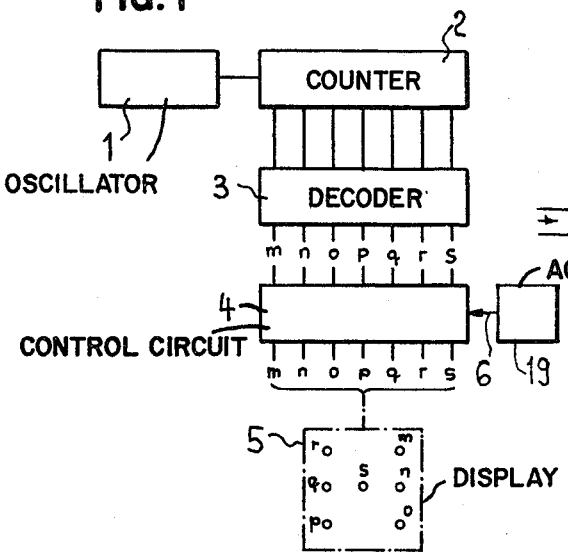
FIG. 1 is a block diagram of a first embodiment of the invention.

The embodiment represented in FIG. 1 shows an oscillator 1 connected to the input of a binary counter 2. The outputs of the counter 2 are connected to the inputs of a decoder 3 from which the outputs m to s are connected to the corresponding inputs of a control circuit 4. The outputs m to s of the control circuit 4 are each connected to one of the display elements m to s of a display 5. The display elements m to s are disposed in such a way as to make possible to display images which correspond at each of the faces of a disc. The decoder 8 is designed in such a way that the states corresponding to the numbers 1 to 6 are sequentially scanned.

In the embodiment of FIG. 1, the oscillator 1, the counter 2 and the decoder 3 are continuously working and the states of the outputs m to s of the decoder 3 are changing sequentially. When a control signal, as given by an actuator 19, a push-button for example, is delivered to the control input 6 of the control circuit 4, the instantaneous states of the inputs m to s of this circuit are memorized in the latter and delivered to the outputs m to s of the control circuit 4 and to the elements m to s of the display 5. An image corresponding to the state of the decoder at the time when the control signal appears to the input 6 is thus displayed. The display time can be controlled by the duration of the control signal delivered to the control circuit 4. During the next operation the control circuit 4 shall memorize and deliver a state at random of the outputs of the decoder 3 to the display 5 in order to display any number.

The oscillator 1 and the counter 2 can be the same as those used for the display of the time.

Figure 3:
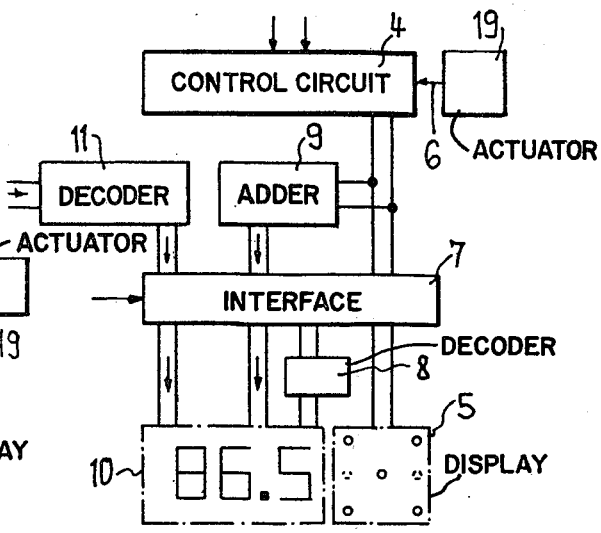
FIG. 3 is a block diagram of part of the electronic circuits of the variant according to FIG. 2.
Figure 2:
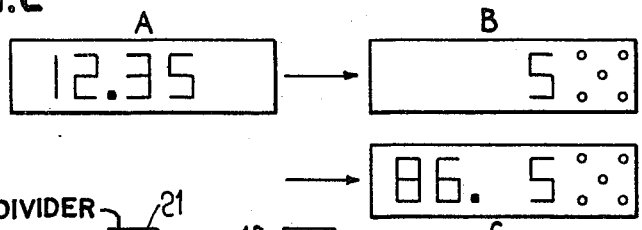
FIG. 2 shows how the display provided for the indication of the time can be used for the indications of a game of chance according to a variant of the first embodiment of the invention.

In the variant represented in the FIGS. 2 and 3, the elements of the display of the time can be alternatively used to display a number corresponding to the throwing of the dice and to indicate a sum of several throwings as represented in FIG. 2, part A. The display is normally utilized to indicate the time in minutes and hours and, according to part B of FIG. 2, it is also possible to display the image of a face of a dice as well as the corresponding number. In a third state of the control circuits it is possible to display the image of a face of a dice, the corresponding number (5) and the sum (86) of several throwings of the player. The FIG. 3 shows a block diagram of the variant of FIG. 2. The control circuit 4, its input 6 and the actuator 19 are corresponding to the elements 4, 6 and 19 of FIG. 1. The outputs of the control circuit 4 are connected to the elements of the display 5 through an interface 7. The same information is delivered to the decimal digit of the units of minutes by a decoder 8 in order to display the number corresponding to the displayed image of the dice. The outputs of the control circuit 4 are also connected to the inputs of an adder 9 which delivers output information through the interface 7 to the decimal normally reserved to the display of the hours of the time display 10. The outputs of a decoder 11 of the time circuits are also connected to the display 10 through the interface 7. One or more control inputs of the interface 7 are used to display alternatively either the time as indicated in part A of FIG. 2 or the result of a throwing of the dice according of part B of FIG. 2 or the result of a throwing of the dice and the sum of several throwings of the dice.

Figure 4:
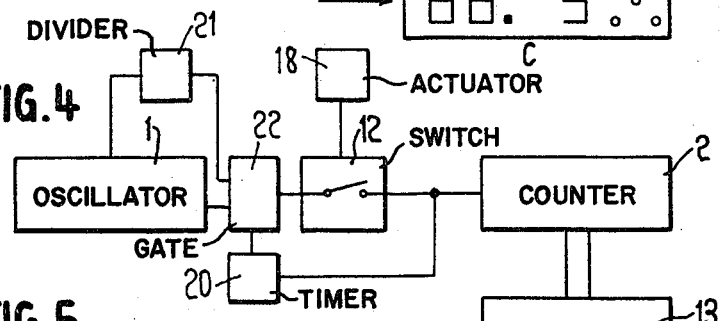
FIG. 4 is a block diagram of a second embodiment of the invention and FIG. 5 represents another variant of the invention

FIG. 4 shows an embodiment where the display represents a simplified game of roulette. The device comprises an oscillator 1 whose first output is connected through the gate 22 and the switch 12 to the input of the counter 2. The second output of the oscillator is connected to a divider 21 whose output is connected to one of the terminals of the gate 22. The gate 22 is actuated by a timer circuit 20 which is controlled by the signal at the input of the counter 2. The switch 12 is controlled by the actuator 18. The outputs of the counter 2 are connected to the inputs of a decoder 13 whose outputs are connected to the display 14. The display 14 comprises a system 15 of sectors which can be individually actuated and a display system 16 with different colors, for example white, red and black.

The timer 20, the divider 21 and the gate 22 are optional and are normally not included in the circuit, the first output of the oscillator 1 being directly connected to the switch 12.

In this case, when the switch 12 is closed, by operating an actuator 18, a push-button, for example, the impulses delivered by the oscillator 1 are counted by the counter 2. According to the state of the counter 2, the states of the outputs of the decoder 13 are changing in such a way as to actuate the sectors of the system 15. These sectors are sequentially actuated in order to give the impression of a rotary system. The strips of the system 16 are also sequentially actuated. When the switch 12 is open, the display rests for a certain time, determined by a timer (not represented) in the state it has reached, thus indicating a number and a color determined. In addition or in the place of the display systems 15 and 16 it is also possible to provide the display of a number corresponding to the number indicated by the system 15.

The above described embodiments may have other characteristics. It is possible to provide a timer and to control the circuits in such a way that the dice or the roulette stops a few seconds after their throwing. Normally, the oscillator delivers a signal whose frequency is sufficiently high so that the player cannot foresee the final state of the dice of the roulette during the manually actuated game. When the variable states of the roulette or the dice are indicated during the game it is possible to switch to a lower frequency, using a timer circuit. One can thus clearly see the final changes of the state of the dice or the roulette. In this case, the optional circuits 20, 21 and 22 are included in the circuit as indicated in FIG. 4. When the switch 12 is actuated, a signal controls the timer which, after a certain time actuates the gate 22 so that the input of the counter 2 receives the low frequency signal from the output of the divider 21. The timer is designed in such a way that when the signal at the input of the counter 2 disappears, the gate 22 switches immediately to the output of the oscillator 1.

Figure 5:
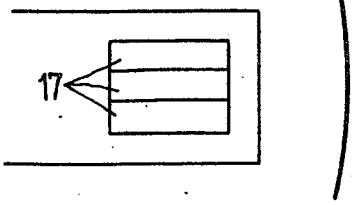

The control of the function "game" can be done without any additional push-button, for example by using the push-button provided for the control of the lighting of the display. However it is also possible to provide one or more additional push-buttons. It is also possible to start the additional circuits used to display the data of a game of chance with a detector of mechanical shocks incorporated in the place of the actuator 18 or 19 in the timepiece. In this case, a change independent of the state of a display is produced by striking the timepiece. Instead of providing displays 16 with colors it is also possible to identify these colors by the activation of a surface 17 designated by indications inscribed on the dial as represented in FIG. 5.

I claim:

1. An electronic timepiece capable of displaying the time and of simulating and displaying a game of chance, said timepiece comprising an oscillator and a display device for indicating the time, at least part of said display device being used to display game elements which simulate a game of chance, wherein at least part of the time measuring circuits of said timepiece are utilized for the game of chance, said timepiece further comprising:

a counter at least indirectly connected to said oscillator for counting the signals delivered at the input of said counter by said oscillator, said oscillator also being used continuously by the time measuring circuits for keeping time;

decoder means connected to the output of said counter for controlling the display of said game elements; and actuator means connected in the circuit of said timepiece after said oscillator for interrupting and storing the continuously changing information counted in said counter, so that the stored information is capable of controlling the display of said game elements.

2. A timepiece as claimed in claim 1 wherein at least part of the elements of the display device which are normally used to display the time measured by the timepiece are alternatively used to display said game elements.

3. A timepiece as claimed in claim 1 wherein a push-button for switching into a game mode also functions to control the lighting intensity of the display.

4. A timepiece as claimed in claim 1 wherein a detector of mechanical shocks included in the timepiece accomplishes the switching into a game mode.

5. An electronic timepiece capable of displaying the time and of simulating and displaying a game of chance, said timepiece comprising an oscillator and a display device for indicating the time, at least part of said display device being used to display game elements which simulate a game of chance, wherein at least part of the time measuring circuits of said timepiece are used for the game of chance, said timepiece further comprising:

a counter connected to said oscillator for counting the signals delivered at the input of said counter by said oscillator, said counter and said oscillator also being continuously used for the keeping of time;

a decoder connected at the output of said counter for controlling the display of said game elements, said decoder continuously functioning in the circuit;

control means connected between said decoder and said display device for storing when actuated a representation of one of the instantaneous states of the continuously changing information at the output of said decoder; and actuator means connected to said control means for actuating said control means whereupon said stored signals are capable of controlling the display of said game elements.

6. A timepiece as claimed in claim 5 wherein said display device is comprised of a first display used for indicating the time and a second display used for displaying said game elements.

7. A timepiece as claimed in claim 6 wherein said second display device is capable of displaying the image of a face of a die.

8. A timepiece as claimed in claim 5 and further including means for displaying a number corresponding to the displayed image.

9. A timepiece as claimed in claim 5 and further including means for calculating the sum of several simulated throwings of a die, and means for displaying said sum.

10. An electronic timepiece capable of displaying the time and of simulating and displaying a game of chance, said timepiece comprising an oscillator and a display device for indicating the time, at least part of said display device being used to display game elements which simulate a game of chance, wherein at least part of the time measuring circuits of said timepiece are utilized for the game of chance, said timepiece further comprising:

a counter at least indirectly connected to said oscillator for counting the signals delivered at the input of said counter by said oscillator, said oscillator also being used continuously by the time measuring circuits for the keeping of time;

a decoder connected between said counter and said display device for controlling the display of said game elements; and actuator means connected at least indirectly between the output of said oscillator and the input of said counter which when actuated produces the counting and the storage in said counter of the signal for said oscillator, the stored information in said counter being used through said decoder to control the display of said game elements when said actuator means is released, said game elements including means for displaying the data of a game of roulette

11. A timepiece as claimed in claim 10 wherein said game elements display a number selected at random.

12. A timepiece as claimed in claim 11 wherein said game elements display said determined number by a system of sectors which are actuated one by one by said decoder so as to simulate a rotary system.

13. A timepiece as claimed in claim 10 and further comprising means to display colors.

14. A timepiece as claimed in claim 10 and further including circuits which diminish the frequency of the change of state of the display at the end of a display sequence in order to simulate the stopping of a die or a roulette.

15. A timepiece as claimed in claim 14 wherein said circuits comprise a divider circuit driven by said oscillator for producing a second signal having a frequency which is less than the frequency of a first signal that controls the display at the beginning of the display sequence; a gate means when actuated for selecting between said first and second signals; and a timer means for actuating said gate means and which is in turn controlled by the signal received by said counter means.

16. Timepiece according to claim 10, and further including circuits which diminish the frequency of the change of state of the display at the end of a display sequence in order to simulate the stopping of a die or a roulette.

* * * * *